US009115728B2

(12) United States Patent
Arisato

(10) Patent No.: US 9,115,728 B2
(45) Date of Patent: Aug. 25, 2015

(54) DIRECTIONAL CONTROL VALVE DEVICE

(75) Inventor: Akira Arisato, Hyogo (JP)

(73) Assignee: KOSMEK LTD., Hyogo (JP)

( * ) Notice: Subject to any disclaimer, the term of this patent is extended or adjusted under 35 U.S.C. 154(b) by 128 days.

(21) Appl. No.: 13/818,385

(22) PCT Filed: Aug. 5, 2011

(86) PCT No.: PCT/JP2011/004472
§ 371 (c)(1),
(2), (4) Date: Feb. 22, 2013

(87) PCT Pub. No.: WO2012/026075
PCT Pub. Date: Mar. 1, 2012

(65) Prior Publication Data

US 2013/0146158 A1 Jun. 13, 2013

(30) Foreign Application Priority Data

Aug. 23, 2010 (JP) ..... 2010-202430

(51) Int. Cl.
*F15B 13/04* (2006.01)

(52) U.S. Cl.
CPC ..... *F15B 13/0402* (2013.01); *F15B 13/0405* (2013.01); *F15B 2211/3057* (2013.01); *F15B 2211/7053* (2013.01); *Y10T 137/7904* (2015.04)

(58) Field of Classification Search
CPC ..... F15B 13/0405; F15B 13/0402; F15B 2211/7053; F15B 2211/3057; Y10T 137/2705; Y10T 137/87169; Y10T 137/87193; Y10T 137/87201; Y10T 137/87209; Y10T 137/87217; Y10T 137/87225; Y10T 137/87241; Y10T 137/7904
USPC ..... 137/596, 596.14–596.2, 87.04; 91/444–447; 60/424, 427
See application file for complete search history.

(56) References Cited

U.S. PATENT DOCUMENTS 3,722,540 A * 3/1973 Mazur et al. ..... 137/596
3,722,541 A * 3/1973 Wilke ..... 137/596

(Continued)

FOREIGN PATENT DOCUMENTS

JP 49-21694 6/1974
JP 4-31302 U 3/1992
JP 4-38144 Y2 9/1992

OTHER PUBLICATIONS

Written Opinion of the ISA for PCT/JP2011/004472, Nov. 15, 2011.
International Search Report for PCT/JP2011/004472, Nov. 12, 2011.

(Continued)

*Primary Examiner* — John K Fristoe, Jr.
*Assistant Examiner* — Craig J Price
(74) *Attorney, Agent, or Firm* — Bacon & Thomas, PLLC

(57) ABSTRACT

A first directional control valve for switching between a first supply position and a first discharge position and a second directional control valve for switching between a second discharge position and a second supply position. A first switching mechanism permits the first directional control valve to be switched to the first supply position in a state where a second switching mechanism has switched the second directional control valve to the second discharge position. In a state where the second switching mechanism has switched the second directional control valve to the second supply position, a pressure fluid supplied to the second directional control valve at the second supply position switches the first directional control valve to the first discharge position via the first switching mechanism.

8 Claims, 5 Drawing Sheets

(56) References Cited

U.S. PATENT DOCUMENTS

| | | | | |
|---|---|---|---|---|
| 3,926,210 | A * | 12/1975 | Rasmussen | 137/596.2 |
| 5,918,631 | A * | 7/1999 | Weiler et al. | 137/596.18 |
| 7,263,924 | B2 * | 9/2007 | Ioku | 91/447 |
| 2005/0276709 | A1 | 12/2005 | Mentink | |

OTHER PUBLICATIONS

Japanese Office Action dated Mar. 17, 2015, including partial translation thereof, for JP 2012-530514.

Revised partial English translation of Japanese Office Action dated Mar. 17, 2015, for JP 2012-530514 (adds last two lines of text, as compared to partial translation filed with IDS on May 21, 2015).

* cited by examiner

DIRECTIONAL CONTROL VALVE DEVICE

TECHNICAL FIELD

The invention relates to a valve device for changing directions in which a pressure fluid such as a pressurized oil is supplied and discharged.

BACKGROUND ART

As such a type of conventional directional control valve device, there is a device disclosed in Patent Literature 1 (Japanese Examined Utility Model Publication No. 4-38144) below.

In the above conventional art, two-way directional control valves of the same type are arranged in parallel, thereby constituting the directional control valve device. The switching positions of operating levers provided to the directional control valves, respectively, are caused to affect each other by a mechanical interlock device.

CITATION LIST

Patent Literature

[PTL 1] Japanese Examined Utility Model Publication No. 4-38144

DISCLOSURE OF THE INVENTION

Problems to be Solved by the Invention

With regard to the above conventional art, room for improvement has been left in the following points.

Since it is necessary to provide an operating lever for each of the directional control valves arranged in parallel, the two operating levers are needed, and the directional control valve device is increased in size. In addition, since it is necessary to operate the two operating levers, the switching operation is troublesome. Moreover, since it is necessary to provide the mechanical interlock device which causes the two operating levers to affect each other in motion, the configuration is complicated.

An object of the present invention is to provide a directional control valve device of which a switching operation is easy and which has a compact and simple configuration.

Solution to the Problems

In order to attain the above object, according to the present invention, a directional control valve device is configured as follows, for example, as shown in FIG. 1 and FIGS. 2 to 4 (or FIGS. 5A to 5C).

The directional control valve device includes: a first directional control valve 11 which is switched between a first supply position X1 where a pressure port P is caused to communicate with a first supply/discharge port A and a first discharge position Y1 where a return port R is caused to communicate with the first supply/discharge port A; a second directional control valve 12 which is switched between a second discharge position Y2 where the return port R is caused to communicate with a second supply/discharge port B and a second supply position X2 where the pressure port P is caused to communicate with the second supply/discharge port B; a first switching mechanism 21 which switches the first directional control valve 11; and a second switching mechanism 22 which switches the second directional control valve 12; and a communication passage 75 which causes a second valve chamber 62 of the second directional control valve 12 to communicate with a pressure chamber 56 of the first switching mechanism 21. The first switching mechanism 21 is configured to permit the first directional control valve 11 to be switched to the first supply position X1 in a state where the second switching mechanism 22 has switched the second directional control valve 12 to the second discharge position Y2. A check valve 31 or 32 which permits a flow from the pressure port P to the first supply/discharge port A and blocks a reverse flow is arranged at least either in the first directional control valve 11 at the first supply position X1 or between the pressure port P and the first directional control valve 11. It is configured that a pressure fluid supplied from the second valve chamber 62 of the second directional control valve 12 at the second supply position X2 to the pressure chamber 56 of the first switching mechanism 21 via the communication passage 75 switches the first directional control valve 11 to the first discharge position Y1 via the first switching mechanism 21 in a state where the second switching mechanism 22 has switched the second directional control valve 12 to the second supply position X2.

The present invention provides the following advantageous effects.

By switching the second directional control valve to the second supply position by the second switching mechanism, the pressure fluid supplied to the second directional control valve can switch the first directional control valve 11 via the first switching mechanism 21. Thus, for switching the two directional control valves, it is only necessary to provide a driving mechanism such as an operating lever only in the second switching mechanism. Therefore, it is not necessary to provide a driving mechanism such as the operating lever for each directional control valve, and the directional control valve device can be made compact.

In addition, since only a single driving mechanism such as the operating lever is enough, a switching operation of the directional control valve device is not troublesome.

Moreover, the mechanical interlock device in the conventional example can be omitted. Thus, the configuration of the directional control valve device is simplified.

Furthermore, even when the pressure port of the directional control valve device is cut off from a pressure fluid source in a state where the first directional control valve is switched to the first supply position, the check valve can prevent the pressure fluid in the first supply/discharge port from flowing out to the pressure port. Thus, a working chamber of a fluid pressure cylinder or the like connected to the first supply/discharge port can be kept at a predetermined pressure.

The present invention preferably additionally has the following configuration.

The check valve 31 is arranged inside of the first directional control valve 11 at the first supply position X1 and is composed of a check member 51 and a check spring 52. The first directional control valve 11 includes a first valve chamber 41, a first valve member 42 which is inserted in the first valve chamber 41 so as to be movable in an axial direction, a first supply valve seat 43 which is provided in an end wall on the pressure port P side among both end walls of the first valve chamber 41, and a first discharge valve seat 44 which is provided in an end wall on the return port R side among both end walls. The first valve member 42 is composed of a closing member 50 which faces the first discharge valve seat 44, the check member 51 which faces the first supply valve seat 43, and the check spring 52 which urges the check member 51 to the first supply valve seat 43. The first switching mechanism 21 includes a first hole 53 which is arranged linearly with respect to the first valve chamber 41 and the first discharge valve seat 44 so as to cause an inside of the first discharge valve seat 44 to communicate with the return port R, a piston 54 which is inserted in the first hole 53 and moved between a state where the closing member 50 is permitted to contact and close the first discharge valve seat 44 and a state where the piston 54 causes the check member 51 to contact and close the first supply valve seat 43 via the closing member 50, and the pressure chamber 56 which presses the piston 54 toward the first valve chamber 41. The second directional control valve 12 includes the second valve chamber 62, a second valve member 63 which is inserted in the second valve chamber 62 so as to be movable in the axial direction, a second supply valve seat 64 which is provided in an end wall on the pressure port P side among both end walls of the second valve chamber 62, and a second discharge valve seat 65 which is provided in an end wall on the return port R side among both end walls. The second switching mechanism 22 includes a second hole 72 which is arranged linearly with respect to the second valve chamber 62 and the second discharge valve seat 65 so as to cause an inside of the second discharge valve seat 65 to communicate with the return port R, an operating member 73 which is inserted in the second hole 72 and moved between a position where the second valve member 63 is caused to contact and close the second supply valve seat 64 and is separated from the second discharge valve seat 65 and a position where the second valve member 63 is separated from the second supply valve seat 64 and is permitted to contact and close the second discharge valve seat 65, a driving mechanism 74 which switches the position of the operating member 73, and the communication passage 75 which causes the second valve chamber 62 to communicate with the pressure chamber 56 of the first switching mechanism 21.

The invention with the above configuration provides the same advantageous effects as those of the above invention, and the directional control valve device can be made further simple and compact.

In addition, the present invention preferably additionally has the following configuration.

The check valve 32 is arranged between the pressure port P and the first directional control valve 11 and is composed of a check member 58, a check spring 59, and a check valve seat 60. The pressure port P is caused to communicate with a first supply valve seat 43 via the check valve seat 60 and a check valve chamber 32*a* in order, and the check member 58 inserted in the check valve chamber 32*a* is urged to the check valve seat 60 by the check spring 59. The first directional control valve 11 includes a first valve chamber 41, a first valve member 42 which is inserted in the first valve chamber 41 so as to be movable in an axial direction, the first supply valve seat 43 which is provided in an end wall on the pressure port P side among both end walls of the first valve chamber 41, and a first discharge valve seat 44 which is provided in an end wall on the return port R side among both end walls. The first switching mechanism 21 includes a first hole 53 which is arranged linearly with respect to the first valve chamber 41 and the first discharge valve seat 44 so as to cause an inside of the first discharge valve seat 44 to communicate with the return port R, a piston 54 which is inserted in the first hole 53 and moved between a state where the first valve member 42 is permitted to contact and close the first discharge valve seat 44 and a state where the piston 54 causes the first valve member 42 to contact and close the first supply valve seat 43, and the pressure chamber 56 which presses the piston 54 toward the first valve chamber 41. The second directional control valve 12 includes the second valve chamber 62, a second valve member 63 which is inserted in the second valve chamber 62 so as to be movable in the axial direction, a second supply valve seat 64 which is provided in an end wall on the pressure port P side among both end walls of the second valve chamber 62, and a second discharge valve seat 65 which is provided in an end wall on the return port R side among both end walls. The second switching mechanism 22 includes a second hole 72 which is arranged linearly with respect to the second valve chamber 62 and the second discharge valve seat 65 so as to cause an inside of the second discharge valve seat 65 to communicate with the return port R, an operating member 73 which is inserted in the second hole 72 and moved between a position where the second valve member 63 is caused to contact and close the second supply valve seat 64 and is separated from the second discharge valve seat 65 and a position where the second valve member 63 is separated from the second supply valve seat 64 and is permitted to contact and close the second discharge valve seat 65, a driving mechanism 74 which switches the position of the operating member 73, and the communication passage 75 which causes the second valve chamber 62 to communicate with the pressure chamber 56 of the first switching mechanism 21.

The invention with the above configuration provides the same advantageous effects as those of the above invention, and the directional control valve device can be made further simple and compact.

The present invention preferably additionally has the following configuration.

The check valve 31 is arranged inside of the first directional control valve 11 at the first supply position X1 and is composed of a check member 51 and a check spring 52. The first valve member 42 is composed of a closing member 50 which faces the first discharge valve seat 44, the check member 51 which faces the first supply valve seat 43, and the check spring 52 which urges the check member 51 to the first supply valve seat 43, and is configured such that the piston 54 causes the check member 51 to contact and close the first supply valve seat 43 via the closing member 50.

In addition, in the present invention, preferably, the check member 51 is inserted in the closing member 50, and the check spring 52 is mounted between the closing member 50 and the check member 51. In this case, the second valve member composed of the closing member and the check member can be made compact.

Furthermore, in the present invention, preferably, the first valve chamber 41 and the first hole 53 and the second valve chamber 62 and the second hole 72 are arranged linearly. In this case, the directional control valve device can be made further compact by reducing the height of a housing thereof.

BRIEF DESCRIPTION OF THE DRAWINGS

FIG. 5A is a diagram similar to FIG. 2, FIG. 5B is a diagram similar to FIG. 3, and FIG. 5C is a diagram similar to FIG. 4.

DESCRIPTION OF THE REFERENCE CHARACTERS

Figure 1:
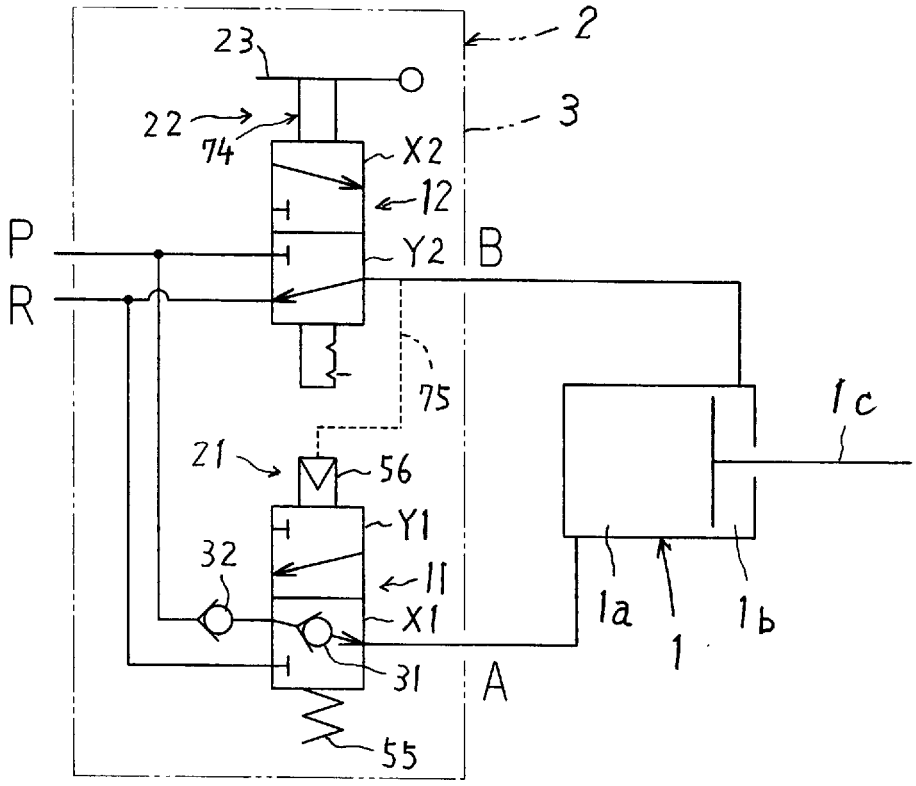
FIG. 1 illustrates a first embodiment of the present invention and is a schematic diagram showing a circuit of a hydraulic system which employs a directional control valve device according to the present invention.

11 first directional control valve
12 second directional control valve
21 first switching mechanism
22 second switching mechanism
31 check valve (first check valve)
32 check valve (second check valve)
32*a* check valve chamber
41 first valve chamber
42 first valve member
43 first supply valve seat
44 first discharge valve seat
50 closing number
51 check member
52 check spring
53 first hob
54 piston
55 spring
56 pressure chamber
58 check member
59 check spring
60 check valve seat
62 second valve chamber
63 second valve member
64 second supply valve seat
65 second discharge valve seat
72 second hob
73 operating number
74 driving mechanism
75 communication passage
A first supply/discharge port
B second supply/discharge port
P pressure port
R return port
X1 first supply position
X2 second supply position
Y1 first discharge position
Y2 second discharge position

DESCRIPTION OF EMBODIMENTS

FIGS. 1 to 4 illustrate a first embodiment of the present invention.

In this embodiment, a case is illustrated in which the present invention is applied to a hydraulic system which drives a double-acting hydraulic cylinder. First, the configuration of the hydraulic system will be described with reference to the schematic diagram of FIG. 1.

Reference numeral 1 denotes the double-acting hydraulic cylinder. Reference numeral 2 denotes a directional control valve device. In addition, reference numeral 3 denotes a housing of the directional control valve device 2.

The directional control valve device 2 includes a first directional control valve 11 and a second directional control valve 12.

The first directional control valve 11 is switched by a first switching mechanism 21 between a first supply position X1 where a pressure port P is caused to communicate with a first supply/discharge port A and a first discharge position Y1 where a return port R is caused to communicate with the first supply/discharge port A.

In addition, the second directional control valve 12 is switched by a second switching mechanism 22 between a second discharge position Y2 where the return port R is caused to communicate with a second supply/discharge port B and a second supply position X2 where the pressure port P is caused to communicate with the second supply/discharge port B. The second switching mechanism 22 has an operating lever 23.

The first directional control valve 11, the second directional control valve 12, the first switching mechanism 21, and the second switching mechanism 22 are provided in the housing 3.

The first switching mechanism 21 is configured to permit the first directional control valve 11 to be switched to the first supply position X1 in a state where the second switching mechanism 22 has switched the second directional control valve 12 to the second discharge position Y2.

In addition, it is configured that a pressurized oil that has been supplied to the second directional control valve 12 at the second supply position X2 switches the first directional control valve 11 to the first discharge position Y1 via the first switching mechanism 21 in a state where the second switching mechanism 22 has switched the second directional control valve 12 to the second supply position X2.

In the first directional control valve 11 at the first supply position X1, a check valve (hereinafter, referred to as a first check valve) 31 is arranged which allows a flow from the pressure port P to the first supply/discharge port A and blocks a reverse flow. In addition, a check valve (hereinafter, referred to as a second check valve) 32 having the same function as above is arranged also between the pressure port P and the first directional control valve 11.

The structure of the directional control valve device 2 having the above configuration will be described with reference to a cross-sectional view of FIG. 2.

The first supply/discharge port A, the second supply/discharge port B, the pressure port P, and the return port R are opened in a lower surface of the housing 3 in this embodiment.

The first directional control valve 11 is provided in a left portion of the housing 3, and includes a first valve chamber 41, a first valve member 42 which is inserted in the first valve chamber 41 so as to be movable in a left-right direction (axial direction), a first supply valve seat 43 which is provided in a right end wall among both left and right end walls of the first valve chamber 41, and a first discharge valve seat 44 which is provided in the left end wall among both end walls.

The first supply valve seat 43 communicates with the pressure port P via a check valve chamber 32*a* of the second check valve 32, an inverted-T-shaped passage 45, a cylindrical supply filter 46, and a vertical passage 47. In addition, the first discharge valve seat 44 communicates with the return port R via a later-described first hole 53 and a horizontal passage 48. Therefore, the right end wall of the first valve chamber 41 is an end wall on the pressure port P side, and the left end wall of the first valve chamber 41 is an end wall on the return port R side.

The first check valve 31 is provided in the first directional control valve 11. In other words, the first valve member 42 is composed of a closing member 50 which faces the first discharge valve seat 44, a check member 51 which faces the first supply valve seat 43, and a check spring 52 which urges the check member 51 to the first supply valve seat 43.

The first switching mechanism 21 includes the first hole 53 which is arranged linearly with respect to the first valve chamber 41 and the first discharge valve seat 44 so as to cause the inside of the first discharge valve seat 44 to communicate with the return port R, a piston 54 which is hermetically inserted in the first hole 53 so as to be movable in the left-right direction, a spring 55 which urges the piston 54 leftward (in the direction away from the closing member 50), and a pressure chamber 56 which presses the piston 54 rightward (in the direction toward the first valve chamber 41).

Figure 2:
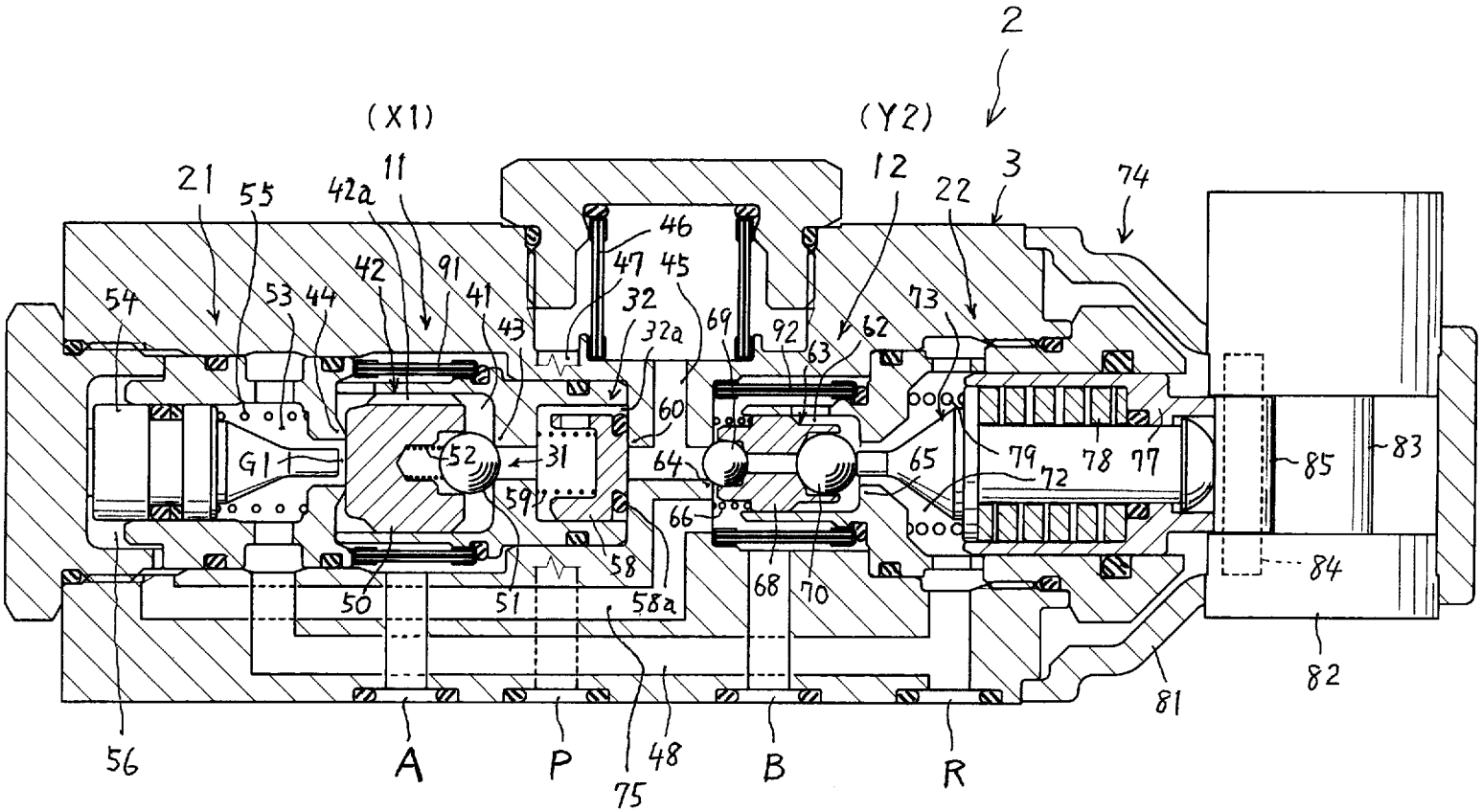
FIG. 2 is a cross-sectional view of the directional control valve device and shows a state where a pressure port is caused to communicate with a first supply/discharge port and a return port is caused to communicate with a second supply/discharge port.

In the state of FIG. 2, a predetermined contact gap G1 is formed between the right end of the piston 54 and the left end of the closing member 50. Thus, the closing member 50 is permitted to contact and close the first discharge valve seat 44. On the other hand, in the state of FIG. 4 described later, the piston 54 is configured to cause the check member 51 to contact and close the first supply valve seat 43 via the closing member 50.

It is noted that a valve face of the closing member 50 is preferably composed of an elastic member (not shown) such as a synthetic resin.

The second check valve 32 is configured to cause a check member 58 inserted in the check valve chamber 32*a* to contact and close a check valve seat 60 by a check spring 59. A valve face of the check member 58 is preferably composed of an elastic member 58*a* such as a synthetic resin or rubber as shown in the drawing.

The second directional control valve 12 is provided in a right portion of the housing 3, and includes a second valve chamber 62, a second valve member 63 which is inserted in the second valve chamber 62 so as to be movable in the left-right direction (axial direction), a second supply valve seat 64 which is provided in a left end wall among both end walls of the second valve chamber 62, a second discharge valve seat 65 which is provided in a right end wall among both end walls, and a spring 66 which urges the second valve member 63 rightward.

In this embodiment, the second valve member 63 is composed of a sleeve 68, a small-diameter ball 69 which is fixedly fitted in the left end of the sleeve 68, and a large-diameter ball 70 which is fixedly fitted in the right end of the sleeve 68.

It is noted that it is possible to omit the spring 66.

The second supply valve seat 64 communicates with the pressure port P via the inverted-T-shaped passage 45. In addition, the second discharge valve seat 65 communicates with the return port R via a later-described second hole 72. Therefore, the left end wall of the second valve chamber 62 is an end wall on the pressure port P side, and the right end wall of the second valve chamber 62 is an end wall on the return port R side.

The second switching mechanism 22 includes the second hole 72 which is arranged linearly with respect to the second valve chamber 62 and the second discharge valve seat 65 so as to cause the inside of the second discharge valve seat 65 to communicate with the return port R, an operating member 73 which is inserted in the second hole 72, a driving mechanism 74 which moves the operating member 73 to a predetermined position in the left-right direction, and a communication passage 75 which causes the second valve chamber 62 to communicate with the pressure chamber 56 of the first switching mechanism 21.

In the state of FIG. 2, the operating member 73 causes the small-diameter ball 69 of the second valve member 63 to contact and close the second supply valve seat 64 and separates the large-diameter ball 70 of the second valve member 63 from the second discharge valve seat 65. On the other hand, in the state of FIG. 4 described later, a predetermined contact gap G2 is formed between the left end of the operating member 73 and the large-diameter ball 70. Thus, the large-diameter ball 70 is permitted to contact and close the second discharge valve seat 65.

The driving mechanism 74 is configured as follows.

A tubular member 77 is inserted in the right portion of the housing 3 so as to be freely movable in the left-right direction, and the operating member 73 is inserted in the tubular member 77 so as to be freely movable in the left-right direction. Between the tubular member 77 and the operating member 73, a pressing spring 78 is mounted which urges the operating member 73 leftward. In addition, between the housing 3 and the operating member 73, a return spring 79 is mounted which urges the operating member 73 rightward.

Furthermore, a bracket 81 is fixed to the right portion of the housing 3, and a vertical shaft 82 is supported by the bracket 81 so as to be freely rotatable about a vertical axis. A reduced-diameter portion 83 is formed in a middle portion of the shaft 82 in an up-down direction, and a pin 84 is provided at a left-side eccentric position with respect to the reduced diameter portion 83. A roller 85 fitted on the pin 84 is in contact with the right end of the tubular member 77.

Although not shown in FIG. 2, the operating lever 23 in FIG. 1 is mounted on the shaft 82 and is configured to be able to lock the shaft 82 at a predetermined rotational position and to unlock the shaft 82. This point is the same as in the operating levers indicated in the above conventional art (Japanese Examined Utility Model Publication No. 4-38144).

An operation of the directional control valve device 2 will be described based on FIGS. 2 to 4 with reference to FIG. 1.

As shown in FIG. 1, when the hydraulic cylinder 1 is extended, the operating lever 23 of the second switching mechanism 22 switches the second directional control valve 12 to the second discharge position Y2, and the first switching mechanism 21 permits the first directional control valve 11 to be switched to the first supply position X1 (here, a state is shown in which the first directional control valve 11 is switched to the first supply position X1). Thus, the pressurized oil in the pressure port P is supplied to a first working chamber 1*a* of the hydraulic cylinder 1 via the second check valve 32, the first check valve 31, and the first supply/discharge port A, and the pressure oil in a second working chamber 1*b* of the hydraulic cylinder 1 is discharged to the return port R via the second supply/discharge port B. Thus, a piston rod 1*c* of the hydraulic cylinder 1 moves rightward to fix a workpiece (not shown).

Even when the pressure port P of the directional control valve device 2 is cut off from a hydraulic pressure source in this state, the two check valves 31 and 32 can prevent the pressurized oil in the first supply/discharge port A from flowing out to the pressure port P. Thus, the first working chamber 1*a* is kept at a predetermined pressure.

In the above extending operation state, as shown in FIG. 2, the operating lever 23 (see FIG. 1) rotates the shaft 82 to a shown rotational position, and the roller 85 moves the operating member 73 to a leftward advancement position via the tubular member 77 and the pressing spring 78. Here, since the operating lever 23 is configured to lock the shaft 82 at the rotational position, the operating member 73 is retained at the advancement position.

Then, the operating member 73 at the above advancement position separates the large-diameter ball 70 of the second valve member 63 from the second discharge valve seat 65 and causes the small-diameter ball 69 to contact the second supply valve seat 64. In other words, the second directional control valve 12 is switched to the second discharge position Y2.

In addition, the spring 55 of the first switching mechanism 21 moves back the piston 54 leftward to permit the check member 51 of the first directional control valve 11 to be separated from the first supply valve seat 43 against the check spring 52, and the check spring 52 causes the closing member 50 to contact the first discharge valve seat 44. In other words, the first directional control valve 11 is switched to the first supply position X1.

Therefore, the pressurized oil in the pressure port P flows through the vertical passage 47, the supply filter 46, and the inverted-T-shaped passage 45, then presses and opens the check member 58 of the second check valve 32, subsequently presses and opens the check member 51 of the first check valve 31, and then is supplied to the first supply/discharge port A via the first valve chamber 41, a horizontal groove 42*a* of the first valve member 42, and a cylindrical first filter 91.

Furthermore, the pressurized oil in the second supply/discharge port B is discharged to the return port R via a cylindrical second filter 92, the second valve chamber 62, and the second hole 72.

Even when the pressure port P is cut off from the hydraulic pressure source in the above state, the check member 51 of the first check valve 31 is in contact with the first supply valve seat 43, and further the elastic member 58*a* of the check member 58 of the second check valve 32 is in contact with the check valve seat 60. Thus, the pressurized oil in the first supply/discharge port A can be reliably prevented from flowing out to the pressure port P.

In FIG. 1, when the hydraulic cylinder 1 is switched from the shown extended state to a retracted state, the second directional control valve 12 is switched to the second supply position X2 by the operating lever 23. Then, the pressurized oil that has been supplied to the second directional control valve 12 at the second supply position X2 switches the first directional control valve 11 to the first discharge position Y1 via the first switching mechanism 21. Thus, the pressurized oil in the pressure port P is supplied to the second working chamber 1*b* via the second supply/discharge port B, and the pressurized oil in the first working chamber 1*a* is discharged to the return port R via the first supply/discharge port A. Accordingly, the piston rod 1*c* of the hydraulic cylinder 1 retracts leftward.

An operation of the directional control valve device 2 during the above switching will be described based on FIGS. 2 to 4.

Figure 3:
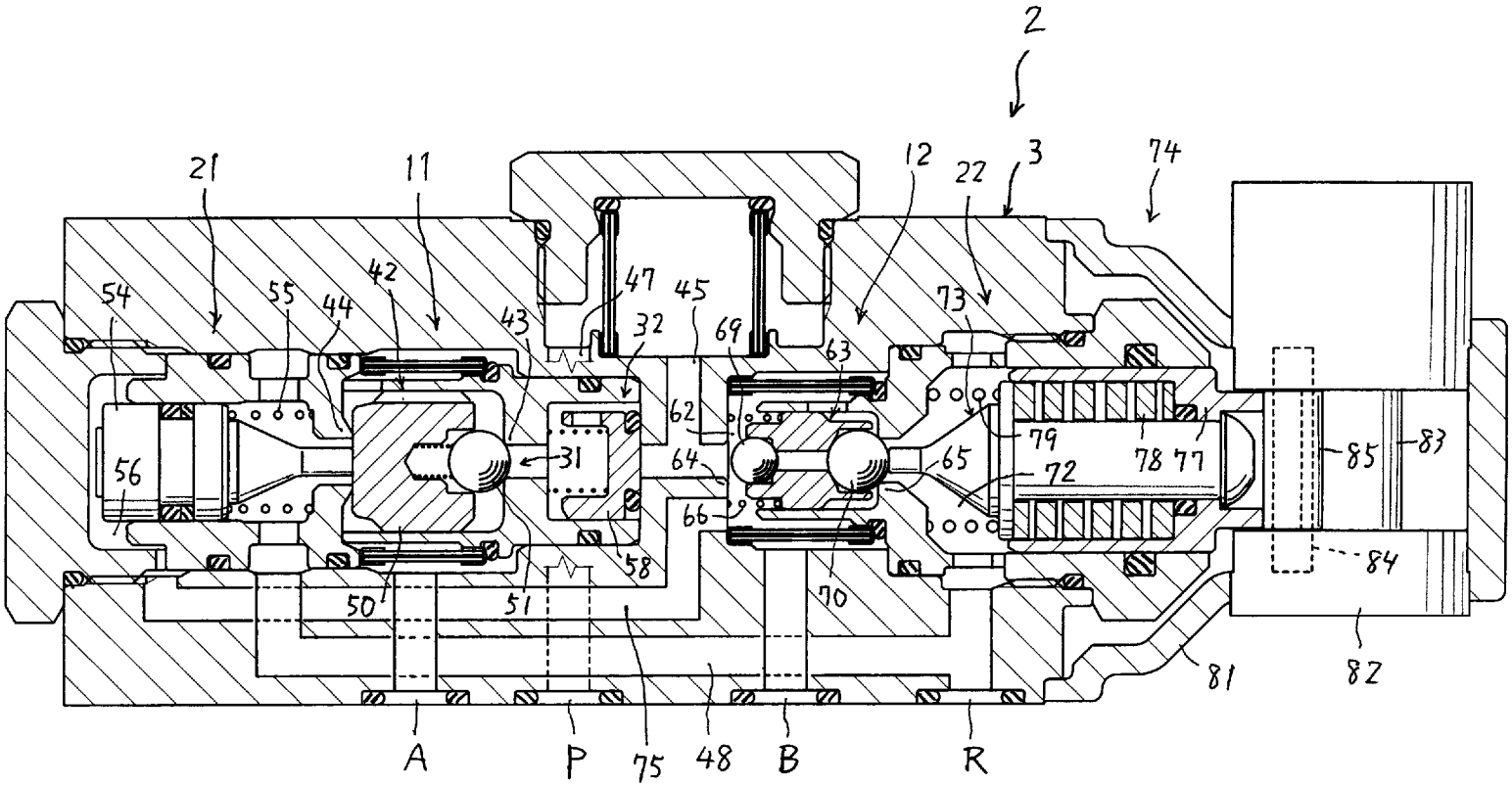
FIG. 3 is a cross-sectional view of the directional control valve device and shows a state in the middle of switching from FIG. 2 to FIG. 4.
Figure 4:
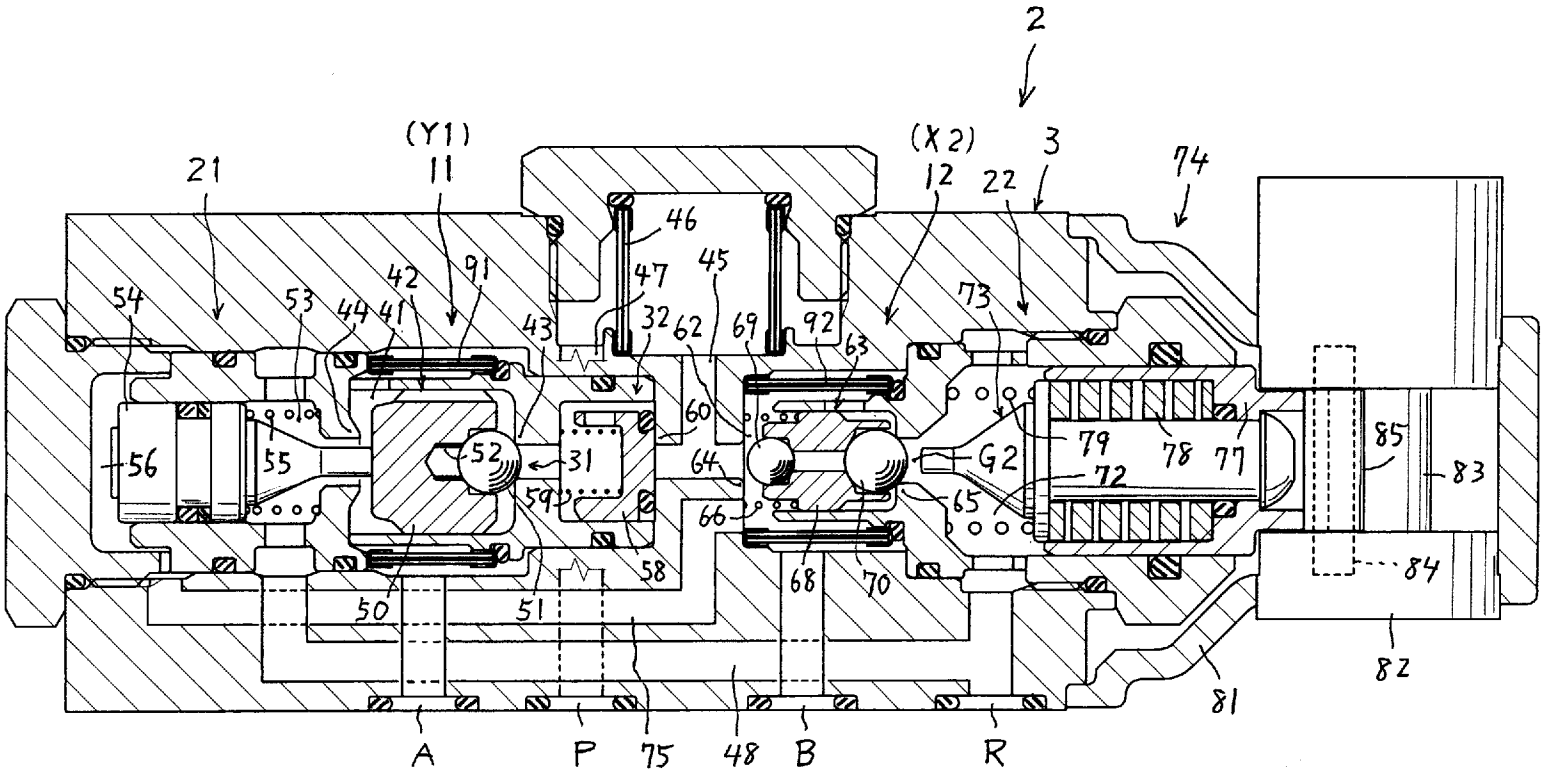
FIG. 4 is a cross-sectional view of the directional control valve device and shows a state where the pressure port is caused to communicate with the second supply/discharge port and the return port is caused to communicate with the first supply/discharge port.

In the state of FIG. 3 in the middle of the operating lever 23 (see FIG. 1) switching the shaft 82 from the rotational position in FIG. 2 to a rotational position in FIG. 4, the roller 85 moves rightward with the rotation of the shaft 82, and thus the return spring 79 moves back the operating member 73 (and the tubular member 77) rightward. Then, by the spring 66, the small-diameter ball 69 of the second valve member 63 separates from the second supply valve seat 64, and the large-diameter ball 70 starts to contact the second discharge valve seat 65.

Thus, the pressurized oil in the pressure port P is supplied to the second supply/discharge port B via the inverted-T-shaped passage 45, the second valve chamber 62, and the second filter 92. At the same time, the pressurized oil is supplied from the second valve chamber 62 to the pressure chamber 56 of the first switching mechanism 21 via the communication passage 75. Then, the pressurized oil in the pressure chamber 56 moves the piston 54 rightward against the spring 55, and the right end of the piston 54 contacts the left surface of the closing member 50 of the first valve member 42.

Subsequently, as shown in FIG. 4, the roller 85 moves further rightward, and hence the operating member 73 (and the tubular member 77) moves back further rightward, to form the contact gap G2 between the left end of the operating member 73 and the large-diameter ball 70. Thus, by the spring 66, the large-diameter ball 70 reliably contacts the second discharge valve seat 65. In other words, the second directional control valve 12 is switched to the second supply position X2. In addition, the piston 54 having been moved rightward separates the closing member 50 from the first discharge valve seat 44 and causes the check member 51 to contact the first supply valve seat 43 via the closing member 50. In other words, the first directional control valve 11 is switched to the first discharge position Y1.

Thus, the pressurized oil in the first supply/discharge port A is discharged to the return port R via the first filter 91, the first valve chamber 41, the first hole 53, and the horizontal passage 48.

When switching from the state of FIG. 4 to the state of FIG. 2, it is only necessary to switch the second directional control valve 12 to the second discharge position Y2 (see the right side of FIG. 2) by the operating lever 23 (see FIG. 1). Then, the pressurized oil in the pressure chamber 56 of the first switching mechanism 21 is discharged to the return port R via the communication passage 75, the second valve chamber 62, and the second hole 72. Thus, the spring 55 of the first switching mechanism 21 moves back the piston 54 leftward, and the first directional control valve 11 is switched to the first supply position X1 (see the left side of FIG. 2).

The device according to the above embodiment provides the following advantages.

Since the two directional control valves 11 and 12 can be operated to be switched by the single operating lever 23, it is not necessary to provide an operating lever for each directional control valve, and the directional control valve device 2 can be made compact.

As shown in FIG. 2, the first valve chamber 41 and the first hole 53 and the second valve chamber 62 and the second hole 72 are arranged linearly in the left-right direction. Thus, the height of the housing 3 can be reduced, and the directional control valve device 2 can be made further compact.

In addition, in FIG. 2, when the operating lever 23 (see FIG. 1) is operated by mistake in the above pressure-kept state where the pressure port P is cut off from the hydraulic pressure source, the shaft 82 (and the operating member 73 and the second valve member 63) is switched from the state on the right side of FIG. 2 to the state on the right side of FIG. 4. However, in this case as well, as shown on the left side of FIG. 2, the two check members 51 and 58 reliably prevent the pressurized oil in the first supply/discharge port A from flowing out to the pressure port P. Therefore, the directional control valve device 2 is configured to be failsafe.

Figure 5A:
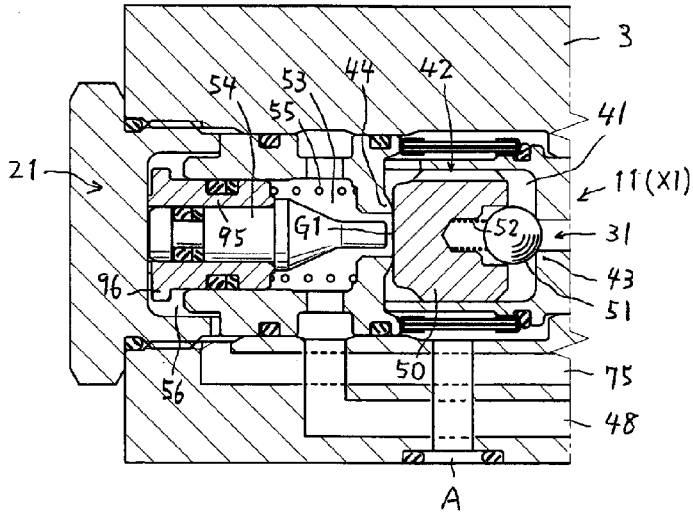
FIGS. 5A to 5C illustrate a second embodiment of the present invention.
Figure 5B:
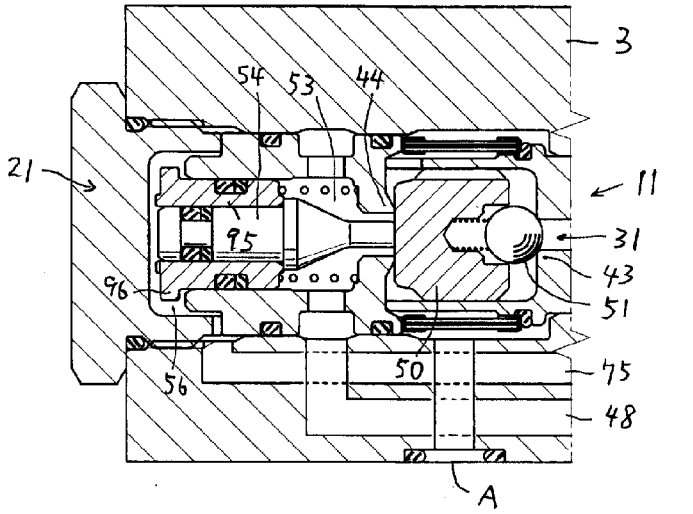
Figure 5C:
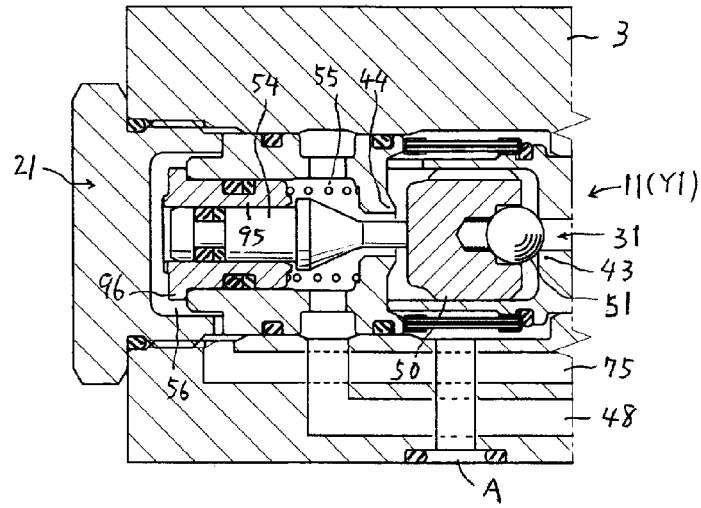

FIGS. 5A to 5C illustrate a second embodiment of the present invention and are diagrams similar to FIGS. 2 to 4, respectively. In the second embodiment, components which are the same as or similar to the components in the above first embodiment are designated at the same reference numerals in principle, and are described.

The second embodiment shows a case where a used pressurized oil is under high pressure, and is different from the above first embodiment in the following points.

An external cylinder 95 is hermetically inserted in the first hole 53 so as to be freely movable in the left-right direction, and the piston 54 is hermetically inserted in the external cylinder 95 so as to be freely movable.

In the state of FIG. 5A, the external cylinder 95 is urged leftward by the spring 55, and the contact gap G1 is formed between the right end of the piston 54 and the closing member 50.

In the state of FIG. 5B, the pressurized oil in the pressure chamber 56 moves the external cylinder 95 and the piston 54 rightward, and the right end of the piston 54 contacts the left surface of the closing member 50.

In the state of FIG. 5C, a flange 96 of the external cylinder 95 is received by the housing 3, and the piston 54 moves rightward relative to the external cylinder 95 to cause the check member 51 to contact the first supply valve seat 43 via the closing member 50.

With the above configuration, the force applied to the piston 54 can be prevented from becoming great even when the used pressurized oil is under high pressure. Thus, the check member 51 can be prevented from being excessively pressed against the first supply valve seat 43, and a long service life is provided.

It is noted that in FIG. 5A, the closing member 50 suffices to be configured to be contactable with the first discharge valve seat 44 when the first directional control valve 11 is at the first supply position X1, and there is no problem even when the right end of the piston 54 contacts the left surface of the closing member 50.

Each embodiment described above can be changed as follows.

Either one of the two check valves, the first check valve 31 or the second check valve 32, may be omitted.

In the case where the first check valve 31 is omitted, the first valve member 42 is composed of only the closing member 50. In this case, it suffices to be configured that the right end of the closing member 50 is caused to contact the first supply valve seat 43. In addition, in this case, instead of the check spring 52, it is preferred to provide a closing spring for urging the closing member 50 to the first discharge valve seat 44. Furthermore, in the case where the first check valve 31 is omitted, instead of the check member 51 and the check spring 52, a ball may be inserted in the closing member 50 so as to face the first supply valve seat 43, and the closing member 50 may be urged to the first discharge valve seat 44 by a closing spring.

Furthermore, in the case where the second check valve 32 is omitted, it is preferred to enhance the sealing performance between the check member 51 of the first check valve 31 and the first supply valve seat 43. In this case, it is conceivable that instead of causing the above both members (i.e. check member 51 and first supply valve seat 43) to contact each other by means of the illustrated metal touch, an elastic sealing member is attached to either one of the both members.

As the means for driving the operating member 73 of the second switching mechanism 22, a solenoid, a fluid pressure actuator such as a pneumatic cylinder or a hydraulic cylinder, or the like may be used instead of the structure using the operating lever 23.

The pressure fluid used in the directional control valve device according to the present invention may be compressed air or the like instead of the pressurized oil.

As a matter of course, various other changes conceivable by those skilled in the art can be made.

The invention claimed is:

1. A directional control valve device comprising:

a first directional control valve configured to be switched between a first supply position and a first discharge position, wherein in said first supply position a pressure port is arranged to communicate with a first supply/discharge port and in said first discharge position a return port is arranged to communicate with the first supply/discharge port;

a second directional control valve configured to be switched between a second discharge position and a second supply position, wherein in said second discharge position the return port is arranged to communicate with a second supply/discharge port and in said second supply position the pressure port is arranged to communicate with the second supply/discharge port;

a first switching mechanism configured to switch the first directional control valve;

a second switching mechanism configured to switch the second directional control valve; and a communication passage configured to cause a second valve chamber of the second directional control valve to communicate with a pressure chamber of the first switching mechanism, wherein the first switching mechanism is configured to permit the first directional control valve to be switched to the first supply position in a state where the second switching mechanism has switched the second directional control valve to the second discharge position, a check valve configured to permit a flow from the pressure port to the first supply/discharge port and blocks a reverse flow by being arranged at least either in the first directional control valve at the first supply position or between the pressure port and the first directional control valve, and said check valve being configured so that a pressure fluid supplied from the second valve chamber of the second directional control valve at the second supply position to the pressure chamber of the first switching mechanism via the communication passage switches the first directional control valve to the first discharge position via the first switching mechanism, in a state where the second switching mechanism has switched the second directional control valve to the second supply position, wherein the check valve is arranged inside of the first directional control valve at the first supply position, said check valve comprising a check member and a check spring, wherein the first directional control valve includes a first valve chamber, a first valve member which is arranged in the first valve chamber so as to be movable in an axial direction, a first supply valve seat which is provided in an end wall on the pressure port side among both end walls of the first valve chamber, and a first discharge valve seat which is provided in an end wall on the return port side among both said end walls, wherein the first valve member comprises a closing member arranged to face the first discharge valve seat, the check member arranged to face the first supply valve seat, and the check spring configured to urge the check member to the first supply valve seat, wherein the first switching mechanism includes a first hole arranged linearly with respect to the first valve chamber and the first discharge valve seat so as to cause an inside of the first discharge valve seat to communicate with the return port, a piston arranged in the first hole and moved between a state where the closing member is permitted to contact and close the first discharge valve seat and a state where the piston causes the check member to contact and close the first supply valve seat via the closing member, and the pressure chamber configured to facilitate pressing the piston toward the first valve chamber, wherein the second directional control valve includes the second valve chamber, a second valve member arranged in the second valve chamber so as to be movable in the axial direction, a second supply valve seat which is provided in an end wall on the pressure port side among both end walls of the second valve chamber, and a second discharge valve seat which is provided in an end wall on the return port side among said both end walls of the second valve chamber, and wherein the second switching mechanism includes a second hole arranged linearly with respect to the second valve chamber and the second discharge valve seat so as to cause an inside of the second discharge valve seat to communicate with the return port, an operating member which is inserted in the second hole and moved between a position where the second valve member is caused to contact and close the second supply valve seat and is separated from the second discharge valve seat and a position where the second valve member is separated from the second supply valve seat and is permitted to contact and close the second discharge valve seat, a driving mechanism configured to switch the position of the operating member, and the communication passage configured to cause the second valve chamber to communicate with the pressure chamber of the first switching mechanism.

2. The directional control valve device according to claim 1, wherein the check member is inserted in the closing member, and the check spring is mounted between the closing member and the check member.

3. The directional control valve device according to claim 1, wherein the first valve chamber and the first hole and the second valve chamber and the second hole are arranged linearly.

4. A directional control valve device comprising:

a first directional control valve configured to be switched between a first supply position and a first discharge position, wherein in said first supply position a pressure port is arranged to communicate with a first supply/discharge port and in said first discharge position a return port is arranged to communicate with the first supply/discharge port;

a second directional control valve configured to be switched between a second discharge position and a second supply position, wherein in said second discharge position the return port is arranged to communicate with a second supply/discharge port and in said second supply position the pressure port is arranged to communicate with the second supply/discharge port;

a first switching mechanism configured to switch the first directional control valve;

a second switching mechanism configured to switch the second directional control valve; and a communication passage configured to cause a second valve chamber of the second directional control valve to communicate with a pressure chamber of the first switching mechanism, wherein the first switching mechanism is configured to permit the first directional control valve to be switched to the first supply position in a state where the second switching mechanism has switched the second directional control valve to the second discharge position, a check valve configured to permit a flow from the pressure port to the first supply/discharge port and blocks a reverse flow by being arranged at least either in the first directional control valve at the first supply position or between the pressure port and the first directional control valve, and said check valve being configured so that a pressure fluid supplied from the second valve chamber of the second directional control valve at the second supply position to the pressure chamber of the first switching mechanism via the communication passage switches the first directional control valve to the first discharge position via the first switching mechanism, in a state where the second switching mechanism has switched the second directional control valve to the second supply position, wherein the check valve is arranged between the pressure port and the first directional control valve, said check valve comprising a check member, a check spring, and a check valve seat, wherein the pressure port is configured to be caused to communicate with a first supply valve seat via the check valve seat and a check valve chamber in order, and the check member inserted in the check valve chamber is configured to be urged to the check valve seat by the check spring, wherein the first directional control valve includes a first valve chamber, a first valve member which is inserted in the first valve chamber so as to be movable in an axial direction, the first supply valve seat which is provided in an end wall on the pressure port side among both end walls of the first valve chamber, and a first discharge valve seat which is provided in an end wall on the return port side among said both end walls, wherein the first switching mechanism includes a first hole arranged linearly with respect to the first valve chamber and the first discharge valve seat so as to cause an inside of the first discharge valve seat to communicate with the return port, a piston which is inserted in the first hole and moved between a state where the first valve member is permitted to contact and close the first discharge valve seat and a state where the piston is configured to cause the first valve member to contact and close the first supply valve seat, and the pressure chamber configured to facilitate pressing the piston toward the first valve chamber, wherein the second directional control valve includes the second valve chamber, a second valve member which is inserted in the second valve chamber so as to be movable in the axial direction, a second supply valve seat which is provided in an end wall on the pressure port side among both end walls of the second valve chamber, and a second discharge valve seat which is provided in an end wall on the return port side among said both end walls of the second valve chamber, and wherein the second switching mechanism includes a second hole which is arranged linearly with respect to the second valve chamber and the second discharge valve seat so as to cause an inside of the second discharge valve seat to communicate with the return port, an operating member which is inserted in the second hole and moved between a position where the second valve member is caused to contact and close the second supply valve seat and is separated from the second discharge valve seat and a position where the second valve member is separated from the second supply valve seat and is permitted to contact and close the second discharge valve seat, a driving mechanism configured to switch the position of the operating member, and the communication passage configured to cause the second valve chamber to communicate with the pressure chamber of the first switching mechanism.

5. The directional control valve device according to claim 4, wherein another check valve is arranged inside of the first directional control valve at the first supply position and comprises another check member and another check spring, and wherein the first valve member comprises a closing member arranged to face the first discharge valve seat, the another check member arranged to face the first supply valve seat, and the another check spring configured to urge the another check member to the first supply valve seat, and is configured such that the piston causes the another check member to contact and close the first supply valve seat via the closing member.

6. The directional control valve device according to claim 5, wherein the another check member is inserted in the closing member, and the another check spring is mounted between the closing member and the another check member.

7. The directional control valve device according to claim 4, wherein the first valve chamber and the first hole and the second valve chamber and the second hole are arranged linearly.

8. The directional control valve device according to claim 5, wherein the first valve chamber and the first hole and the second valve chamber and the second hole are arranged linearly.

* * * * *